US009585463B2

(12) United States Patent
Lourie

(10) Patent No.: US 9,585,463 B2
(45) Date of Patent: Mar. 7, 2017

(54) SHOULDER CARRY ASSIST

(71) Applicant: Edwin R. Lourie, White Plains, NY (US)

(72) Inventor: Edwin R. Lourie, White Plains, NY (US)

( * ) Notice: Subject to any disclaimer, the term of this patent is extended or adjusted under 35 U.S.C. 154(b) by 270 days.

(21) Appl. No.: 14/594,415

(22) Filed: Jan. 12, 2015

(65) Prior Publication Data

US 2015/0201738 A1 Jul. 23, 2015

Related U.S. Application Data

(60) Provisional application No. 61/929,426, filed on Jan. 20, 2014.

(51) Int. Cl.

| | |
|---|---|
| ***A45F 3/10*** | (2006.01) |
| ***A45F 3/14*** | (2006.01) |
| ***A45F 3/04*** | (2006.01) |
| ***A45C 13/30*** | (2006.01) |
| ***A45C 13/38*** | (2006.01) |

(52) U.S. Cl.

CPC ..... *A45F 3/10* (2013.01); *A45C 13/30* (2013.01); *A45C 13/38* (2013.01); *A45F 3/14* (2013.01)

(58) Field of Classification Search

CPC ..... A45F 3/14; A45C 13/30; A45C 13/38

USPC ..... 224/266, 258, 259, 260

See application file for complete search history.

(56) References Cited

U.S. PATENT DOCUMENTS

| | | | | | |
|---|---|---|---|---|---|
| 211,460 | A * | 1/1879 | Corn | A45F 3/15 | 224/266 |
| 460,392 | A * | 9/1891 | Kalbach | A45F 5/00 | 224/265 |
| 741,098 | A * | 10/1903 | Bibler | A45C 13/38 | 224/260 |
| 909,217 | A * | 1/1909 | Presba | A45F 5/00 | 144/288.5 |
| 966,562 | A * | 8/1910 | Knoerzer | A45F 3/15 | 224/266 |
| 1,185,698 | A * | 6/1916 | Miller | A45F 3/14 | 224/260 |
| 1,273,201 | A * | 7/1918 | Teuber | A45C 13/38 | 224/182 |
| 1,281,822 | A * | 10/1918 | Orr | 224/264 | |

(Continued)

FOREIGN PATENT DOCUMENTS

| | | | | |
|---|---|---|---|---|
| DE | 001059162 B | * | 6/1959 | A45C 13/38 |
| FR | 000962373 A | * | 6/1950 | A45C 13/38 |

(Continued)

*Primary Examiner* — Justin Larson
*Assistant Examiner* — Lester L Vanterpool

(57) ABSTRACT

A shoulder carry assist is a device that allows the user to carry loads without having his or her movement restricted and without losing the use of his or her hands. The device features a left shoulder pad and a right shoulder pad that are connected via a left linkage rod, a right linkage rod, and a width-adjustable cross-bar. Loads may be attached to a left load-bearing hanger and a right load-bearing hanger that are attached to the left shoulder pad and the right shoulder pad by a left cord and a right cord, respectively. The left cord and the right cord are guided via a plurality of left offset guides and a plurality of right offset guides as well as a stabilizing guide located on both the left shoulder pad and the right shoulder pad.

20 Claims, 6 Drawing Sheets

(56) References Cited

U.S. PATENT DOCUMENTS 1,727,873 A * 9/1929 Farmer, Jr. ..... A45F 3/14 224/260
1,846,846 A * 2/1932 Coffman ..... A45F 3/14 224/259
1,879,480 A * 9/1932 Pures ..... A45F 3/14 224/260
2,358,551 A * 9/1944 Beaton ..... A61F 5/0118 224/259
2,477,432 A * 7/1949 Walsh ..... A45F 5/00 224/260
2,651,441 A * 9/1953 Rau ..... A45F 3/14 224/259
2,986,314 A * 5/1961 Miller ..... A45F 3/14 224/266
3,181,752 A * 5/1965 Seltzer ..... A45C 13/38 224/260
3,486,671 A * 12/1969 Sanders ..... A61G 1/04 2/467
4,280,645 A * 7/1981 Goodden ..... A45F 3/14 224/259
4,487,347 A * 12/1984 Zegar ..... A45F 3/04 206/315.5
6,315,179 B1 * 11/2001 Hillis ..... A45F 3/14 224/200
2002/0030073 A1 * 3/2002 Duval ..... A45F 3/15 224/266
2002/0148866 A1 * 10/2002 Dent, III ..... B65G 7/12 224/259
2004/0084490 A1 * 5/2004 Caputi ..... A45C 13/30 224/257
2005/0279791 A1 * 12/2005 Komorowski ..... A45C 13/38 224/260
2007/0039983 A1 * 2/2007 Harrison, III ..... A45F 5/00 224/265
2009/0033110 A1 * 2/2009 Fragale ..... A45F 3/14 294/26
2011/0049203 A1 * 3/2011 Stark ..... A45C 13/38 224/255
2012/0000947 A1 * 1/2012 Ashley ..... A45F 3/14 224/257

FOREIGN PATENT DOCUMENTS

FR 001102204 A * 10/1955 ..... A45C 13/38
GB 2466182 A * 6/2010 ..... A45F 5/10
WO WO2010/079476 A1 * 7/2010 ..... A45F 3/14
WO WO2011/151524 A1 * 12/2011 ..... A45F 3/14

* cited by examiner

DETAIL A

SECTION B-B

SHOULDER CARRY ASSIST

The current application claims a priority to the U.S. Provisional Patent application Ser. No. 61/929,426 filed on Jan. 20, 2014.

FIELD OF THE INVENTION

The present invention relates generally to a load-carrying device. More specifically, the present invention is a shoulder carry assist that allows the user to carry loads in a suspended position on the left side and/or the right side of his or her body.

BACKGROUND OF THE INVENTION

When carrying loads such as multiple shopping bags, packages, and parcels for extended periods of time, one must take care to avoid stress and even injury to the arms, shoulders, and back. In addition to the potential for injury, because these types of items must often be carried, the carrier is left without the use of his or her hands. Various types of items such as strapped bags may be slung over the shoulders for more convenient carry. However, carrying objects on one shoulder only can result in the carrying stress being focused and localized solely on the shoulder bearing the load and the corresponding side of the body. This localization of stress can result in an imbalance on the carrier's body as well as cause discomfort and pain over time. The present invention seeks to address the aforementioned issues relating to carrying loads as well as provide the user with a convenient and practical solution.

The present invention is a shoulder carry assist that is designed to facilitate the carrying of various objects by placing the objects into a suspended position on the left side and/or right side of the user's body. Additionally, the present invention does not compromise the user's ability to use his or her hands while carrying a load using the present invention. The present invention is worn on the user's shoulders and is not subjected to any torque or rotational forces due to the load being carried. Additionally, any load applied to either the left side or the right side of the present invention is not transferred to the opposing side. As a result, the user is able to carry a load on only one side of his or her body without causing a negative effect on the opposite side of the body.

DETAIL DESCRIPTIONS OF THE INVENTION

All illustrations of the drawings are for the purpose of describing selected versions of the present invention and are not intended to limit the scope of the present invention.

Figure 1:
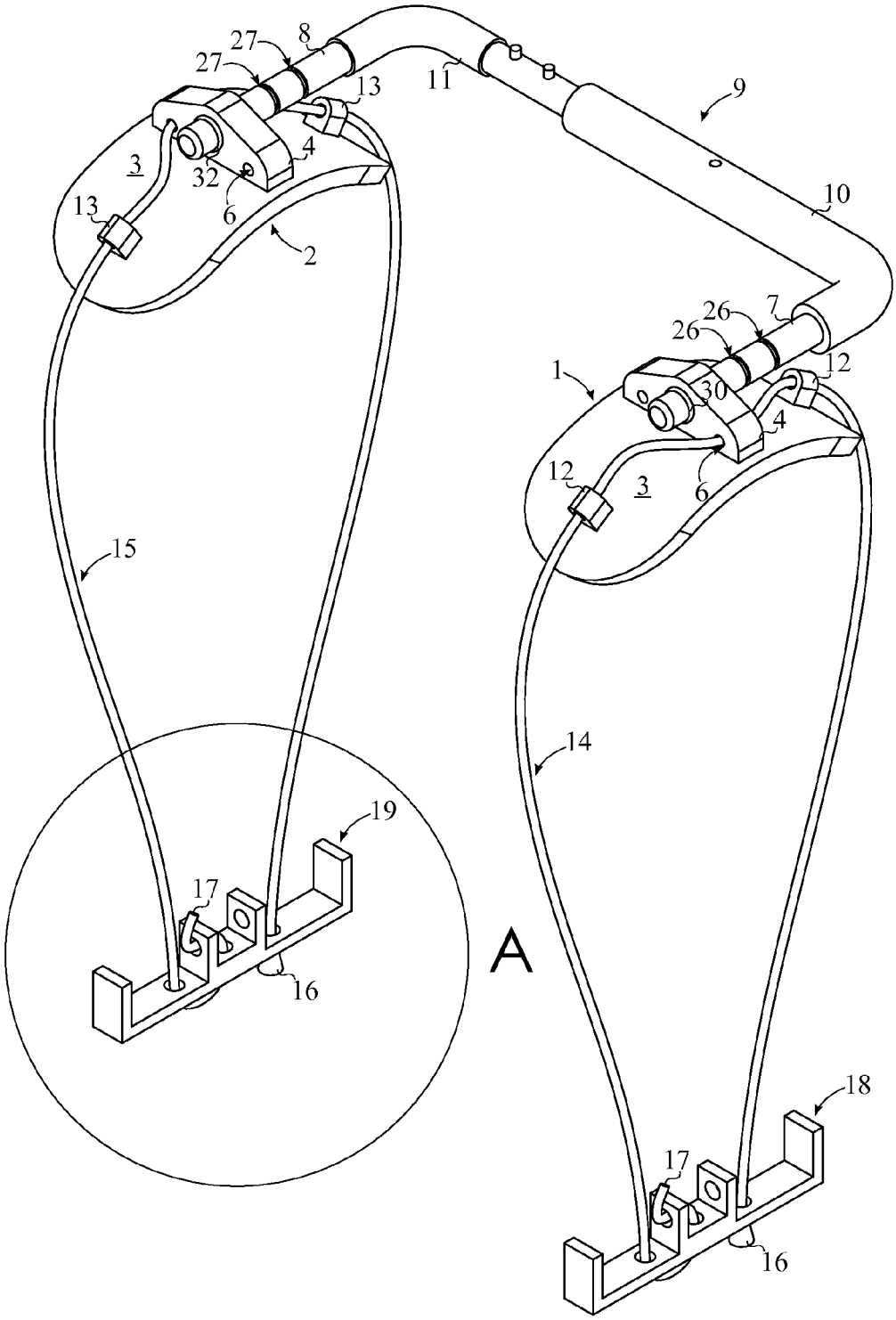
FIG. 1 is a perspective view of the present invention.
Figure 2:
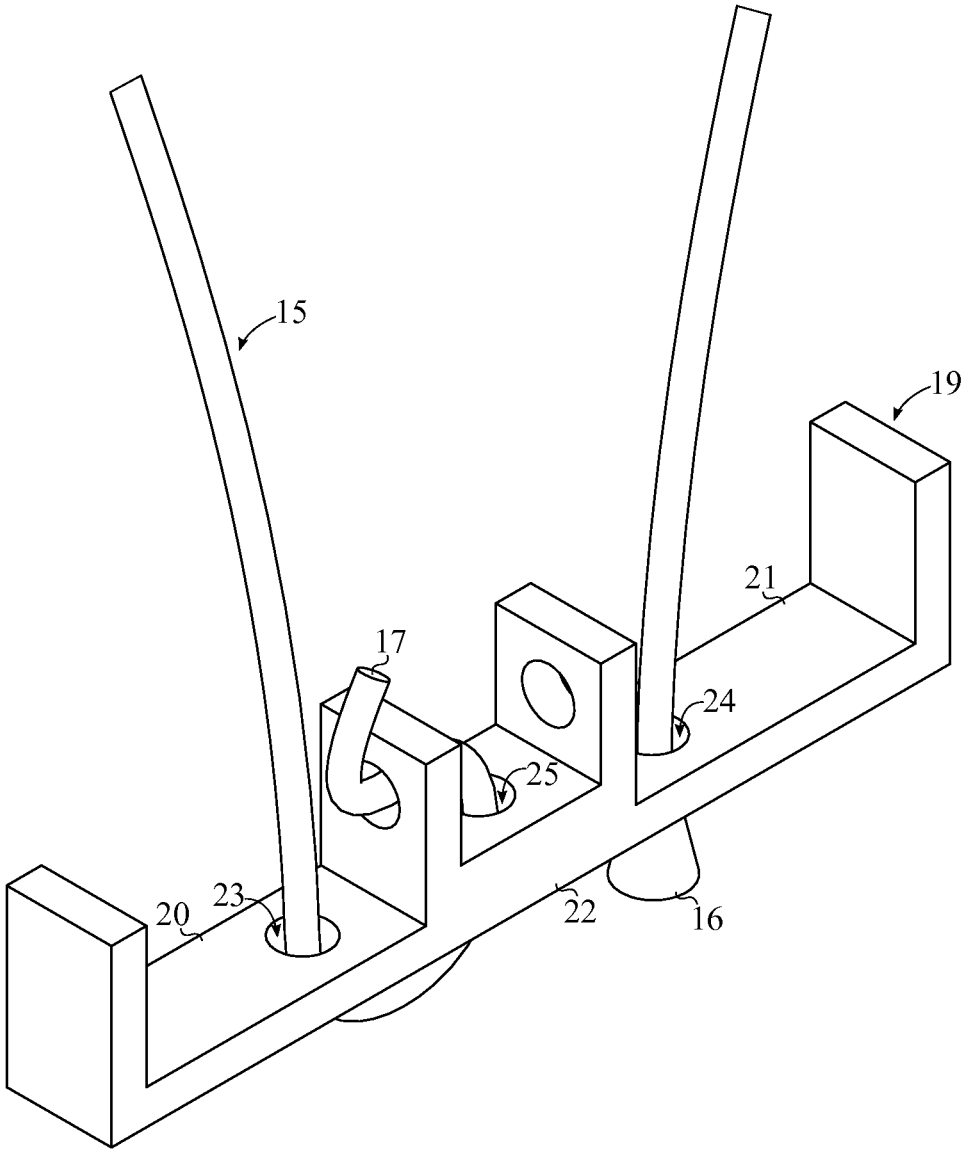
FIG. 2 is a detail view of the right cord taken from circle A of FIG. 1.

The present invention is a shoulder carry assist that is utilized to assist the user in bearing a load without impeding the user's movement or the user's ability to use his or her hands. The present invention is shown in FIGS. 1-6 and comprises a left shoulder pad 1, a right shoulder pad 2, a left linkage rod 7, a right linkage rod 8, a width-adjustable crossbar 9, a left cord 14, a right cord 15, a left load-bearing hanger 18, and a right load-bearing hanger 19. A detail view of the right load-bearing hanger 19 is shown in FIG. 2.

The left shoulder pad 1 and the right shoulder pad 2 are worn on the user's left shoulder and right shoulder, respectively. The left shoulder pad 1 and the right shoulder pad 2 provide padding and comfort for the user's shoulders when the present invention is worn. In the preferred embodiment of the present invention, the left shoulder pad 1 and the right shoulder pad 2 are composed of a soft, firm, and flexible material. The flexibility of the left shoulder pad 1 and the right shoulder pad 2 allow the left shoulder pad 1 and the right shoulder pad 2 to be compressed over the user's corresponding left shoulder and right shoulder when the present invention is bearing a load. Additionally, the left shoulder pad 1 and the right shoulder pad 2 are able to grip the user's shoulders in order to prevent the left shoulder pad 1 and the right shoulder pad 2 from shifting when a load is borne. As tension in the left cord 14 and the right cord 15 increases due to a load, the left shoulder pad 1 and the right shoulder pad 2 are able to correspondingly increase the grip exerted on the user's left shoulder and right shoulder, respectively.

Figure 3:
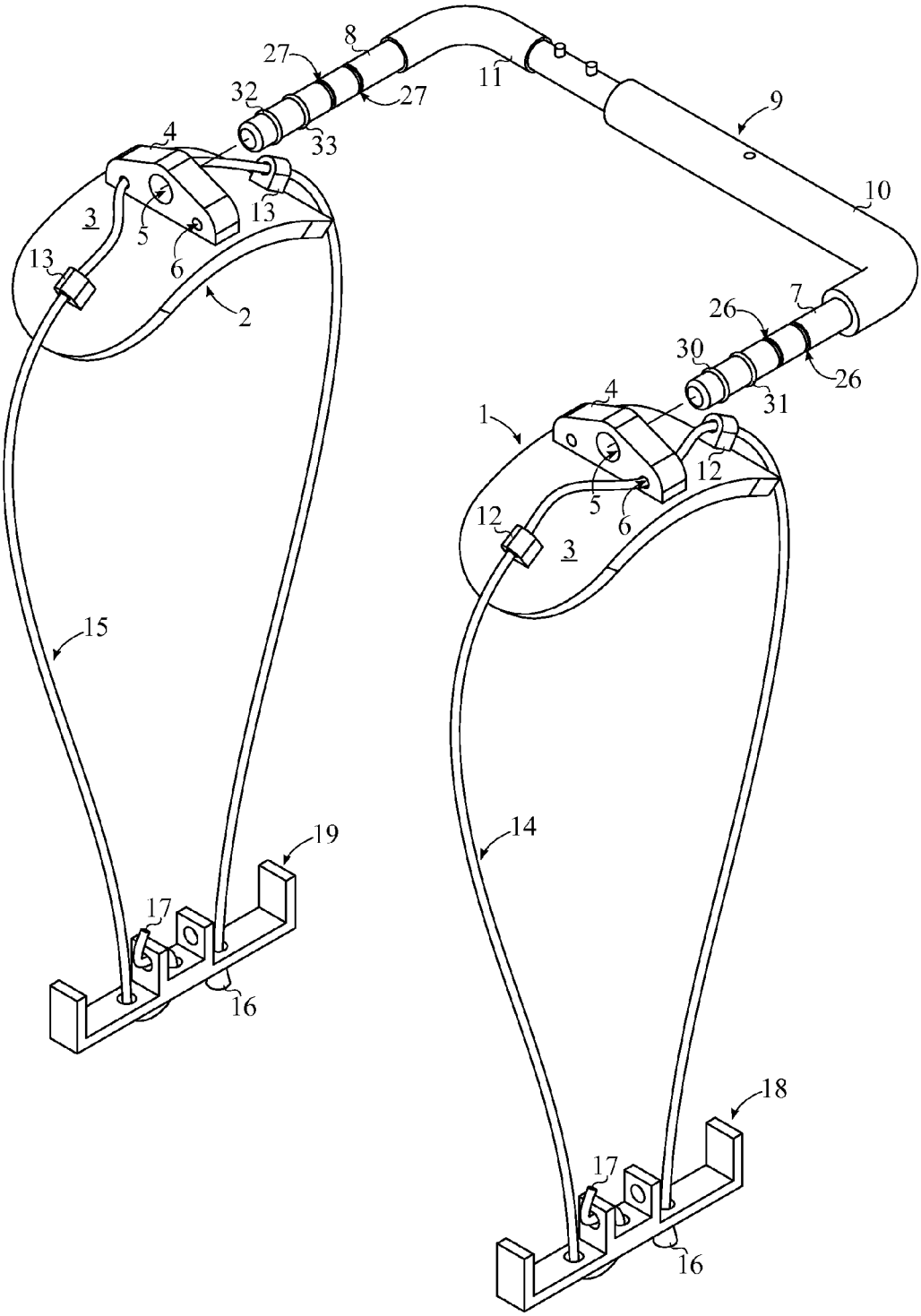
FIG. 3 is a partially exploded perspective view of the present invention.

The left linkage rod 7 and the right linkage rod 8 are utilized to join the left shoulder pad 1 and the right shoulder pad 2. As shown in FIG. 3, the left shoulder pad 1 is slidably mounted to the left linkage rod 7 while the right shoulder pad 2 is similarly slidably mounted to the right linkage rod 8. This allows the positioning of the left shoulder pad 1 and the right shoulder pad 2 to be adjusted in the forward and backward directions as needed according to the user's preferences.

The width-adjustable crossbar 9 allows the positioning of the left shoulder pad 1 and the right shoulder pad 2 to be adjusted in order to position the left shoulder pad 1 closer or farther apart as needed to suit the user. The left linkage rod 7 is adjacently connected to the width-adjustable crossbar 9 while the right linkage rod 8 is adjacently connected to the width-adjustable crossbar 9, opposite to the left linkage rod 7. This allows the right linkage rod 8 to be moved closer to or away from the left linkage rod 7 during adjustment through the width-adjustable crossbar 9.

The left cord 14 and the right cord 15 are utilized to suspend a load from the left shoulder pad 1 and the right shoulder pad 2, respectively. The left load-bearing hanger 18 and the right load-bearing hanger 19 are each able to support a load such as a plastic grocery bag and position the load at the user's left side and right side. The left load-bearing hanger 18 is tethered to the left shoulder pad 1 by the left cord 14 while the right load-bearing hanger 19 is tethered to the right shoulder pad 2 by the right cord 15. The connection between the left load-bearing hanger 18 and the left shoulder pad 1 allows the left shoulder pad 1 to support a load borne by the left load-bearing hanger 18. Similarly, the connection between the right load-bearing hanger 19 and the right shoulder pad 2 allows the right shoulder pad 2 to support a load borne by the right load-bearing hanger 19. The lengths of the left cord 14 and the right cord 15 are adjustable in order to allow the user to adjust the vertical positioning of loads borne by the left load-bearing hanger 18 and the right load-bearing hanger 19 at the user's sides.

Figure 4:
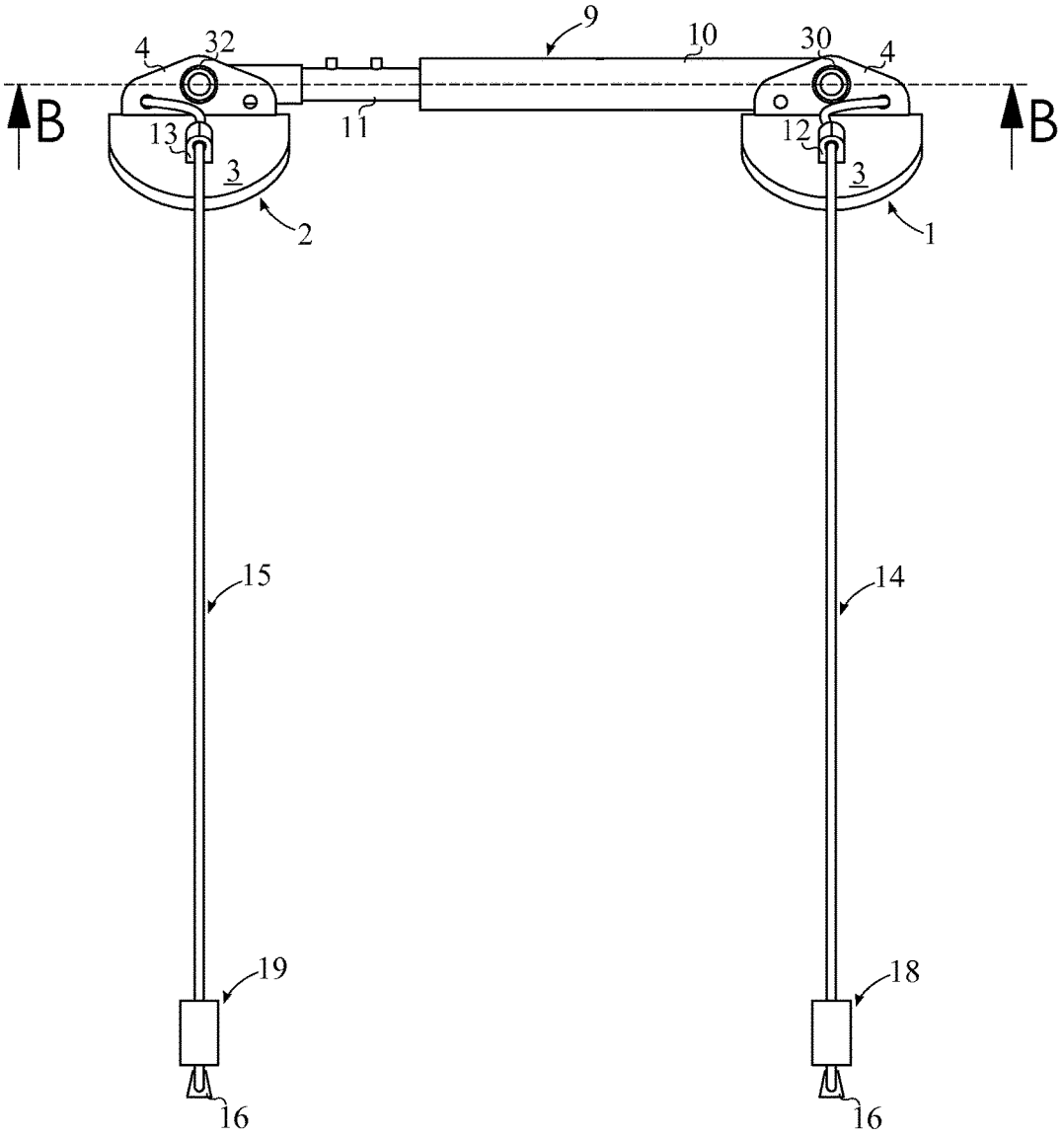
FIG. 4 is a front view of the present invention.
Figure 5:
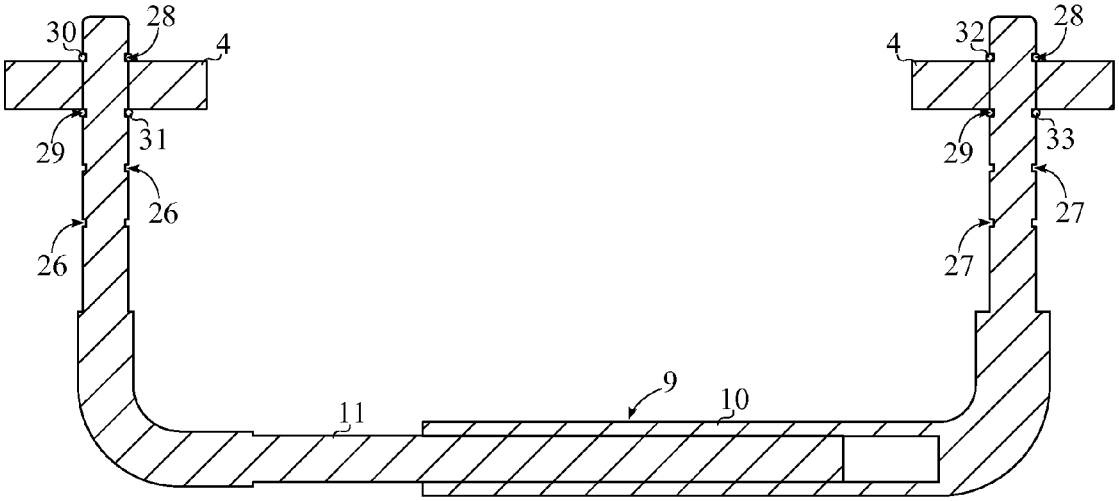
FIG. 5 is a cross-sectional view of the present invention taken along line B-B of FIG. 4.

The width-adjustable crossbar 9 comprises a sleeve 10 and a lockable rod 11. In the preferred embodiment of the present invention, the sleeve 10 and the lockable rod 11 each feature a circular cross-section with the inner cross-sectional diameter of the sleeve 10 and the outer cross-sectional diameter of the lockable rod 11 sized such that the sleeve 10 is able to accommodate the lockable rod 11. The left linkage rod 7 is adjacently connected to the sleeve 10 while the right linkage rod 8 is adjacently connected to the lockable rod 11. As such, when the position of the right linkage rod 8 is adjusted, the right linkage rod 8 and the lockable rod 11 are able to move together toward or away from the left linkage rod 7 and the sleeve 10. As shown in FIG. 4 and FIG. 5, the lockable rod 11 is telescopically engaged into the sleeve 10, opposite to the left linkage rod 7. This allows the lockable rod 11 to telescopically slide within the sleeve 10 when the positioning of the left shoulder pad 1 and the right shoulder pad 2 is adjusted. In the preferred embodiment of the present invention, the left linkage rod 7 is positioned perpendicular to the sleeve 10 and to the lockable rod 11 while the right linkage rod 8 is positioned perpendicular to the lockable rod 11 and to the sleeve 10 as well. This orientation positions the sleeve 10 and the lockable rod 11 behind the user's neck when the present invention is worn while the left shoulder pad 1 and the right shoulder pad 2 are positioned on top of the user's corresponding left shoulder and right shoulder.

The present invention further comprises a plurality of left offset guides 12 and a plurality of right offset guides 13. The plurality of left offset guides 12 and the plurality of right offset guides 13 distribute the left cord 14 and the right cord 15 along the length of the left shoulder pad 1 and the right shoulder pad 2, respectively. Thus, the plurality of left offset guides 12 and the plurality of right offset guides 13 are able to evenly distribute any loads borne onto the user's left shoulder and right shoulder. The plurality of left offset guides 12 is distributed about an upper convex surface 3 of the left shoulder pad 1. Similarly, the plurality of right offset guides 13 is distributed about an upper convex surface 3 of the right shoulder pad 2. As such, the plurality of left offset guides 12 and the plurality of right offset guides 13 allow the corresponding left cord 14 and right cord 15 to slide freely along the length of the left shoulder pad 1 and the right shoulder pad 2. Because the left cord 14 and the right cord 15 are able to slide freely, any load borne on the left cord 14 and the right cord 15 automatically gravitate to the lowest position relative to the user's body, increasing stability of the present invention and the loads during use of the present invention. This eliminates the need to remove the present invention from the user's body when the user sits down as loads automatically gravitate to the user's side. Additionally, the plurality of left offset guides 12 and the plurality of right offset guides 13 are positioned in a manner such that the left cord 14 and the right cord 15 are able to compress the corresponding left shoulder pad 1 and right shoulder pad 2 over the user's shoulders when a load is borne. The left cord 14 traverses through each of the plurality of left offset guides 12 while the right cord 15 traverses through each of the plurality of right offset guides 13. This prevents the left cord 14 and the right cord 15 from separating from the remaining components of the present invention by keeping the left cord 14 contained within each of the plurality of left offset guides 12 and the right cord 15 contained within each of the plurality of right offset guides 13. The left load-bearing hanger 18 is slidably connected along the left cord 14 while the right load-bearing hanger 19 is slidably connected along the right cord 15. As such, the user is able to adjust the positioning of the left load-bearing hanger 18 and the right load-bearing hanger 19 along the length of the corresponding left cord 14 and right cord 15.

The left shoulder pad 1 and the right shoulder pad 2 each comprise a stabilizing guide 4, a rod through hole 5, and at least one cord hole 6. The stabilizing guide 4 is utilized to connect the left shoulder pad 1 and the right shoulder pad 2 to the left linkage rod 7 and the right linkage rod 8, respectively. The rod through hole 5 is able to accept the left linkage rod 7 and the right linkage rod 8 when joined to the left shoulder pad 1 and the right shoulder pad 2. The at least one cord hole 6 serves as a supporting guide for the left cord 14 and the right cord 15 in addition to the plurality of left offset guides 12 and the plurality of right offset guides 13. In the preferred embodiment of the present invention, the stabilizing guide 4 is positioned centrally about and connected normal to the upper convex surface 3. This allows the left linkage rod 7 and the right linkage rod 8 to be connected at the approximate center of the corresponding left shoulder pad 1 and right shoulder pad 2. Additionally, this positioning places the at least one cord hole 6 centrally on the left shoulder pad 1 and the right shoulder pad 2, providing further security for the left cord 14 and the right cord 15. The rod through hole 5 traverses through the stabilizing guide 4 tangent to the upper convex surface 3. This allows the left linkage rod 7 and the right linkage rod 8 to be inserted through the rod through hole 5 and additionally allows adjustment of the positioning of the left linkage rod 7 and the right linkage rod 8. Furthermore, the rod through hole 5 is positioned centrally on the stabilizing guide 4, allowing the stabilizing guide 4 to balance the left shoulder pad 1 and the right shoulder pad 2 when the present invention is worn. The left linkage rod 7 is slidably engaged into the rod through hole 5 of the left shoulder pad 1 while the right linkage rod 8 is slidably engaged into the rod through hole 5 of the right shoulder pad 2. This allows the left linkage rod 7 and the right linkage rod 8 to be slid through the respective rod through hole 5 when the positioning of the left shoulder pad 1 and the right shoulder pad 2 is adjusted.

Again referring to FIG. 3, the at least one cord hole 6 traverses through the stabilizing guide 4 parallel to the rod through hole 5 in order to serve as an additional guide for the left cord 14 and the right cord 15 and further serve to distribute the left cord 14 and the right cord 15 along the length of the left shoulder pad 1 and the right shoulder pad 2 as well as distribute loads onto the user's left shoulder and right shoulder. The at least one cord hole 6 is positioned adjacent to the rod through hole 5 as well in order to place the left cord 14 and the right cord 15 in close proximity to the left linkage rod 7 and the right linkage rod 8. The left cord 14 traverses through the at least one cord hole 6 on the left shoulder pad 1 while the right cord 15 traverses through the at least one cord hole 6 on the right shoulder pad 2. As such, the stabilizing guide 4 of the left shoulder pad 1 is able to contain the left cord 14 within the at least one cord hole 6 of the left shoulder pad 1. Similarly, the stabilizing guide 4 of the right shoulder pad 2 is able to contain the right cord 15 within the at least one cord hole 6 of the right shoulder pad 2. As shown in FIG. 1 and FIG. 3, the approximately triangular orientation of the plurality of left offset guides 12 and the plurality of right offset guides 13 as well as the stabilizing guide 4 cause the left shoulder pad 1 and the right shoulder pad 2 to compress inward.

Figure 6:
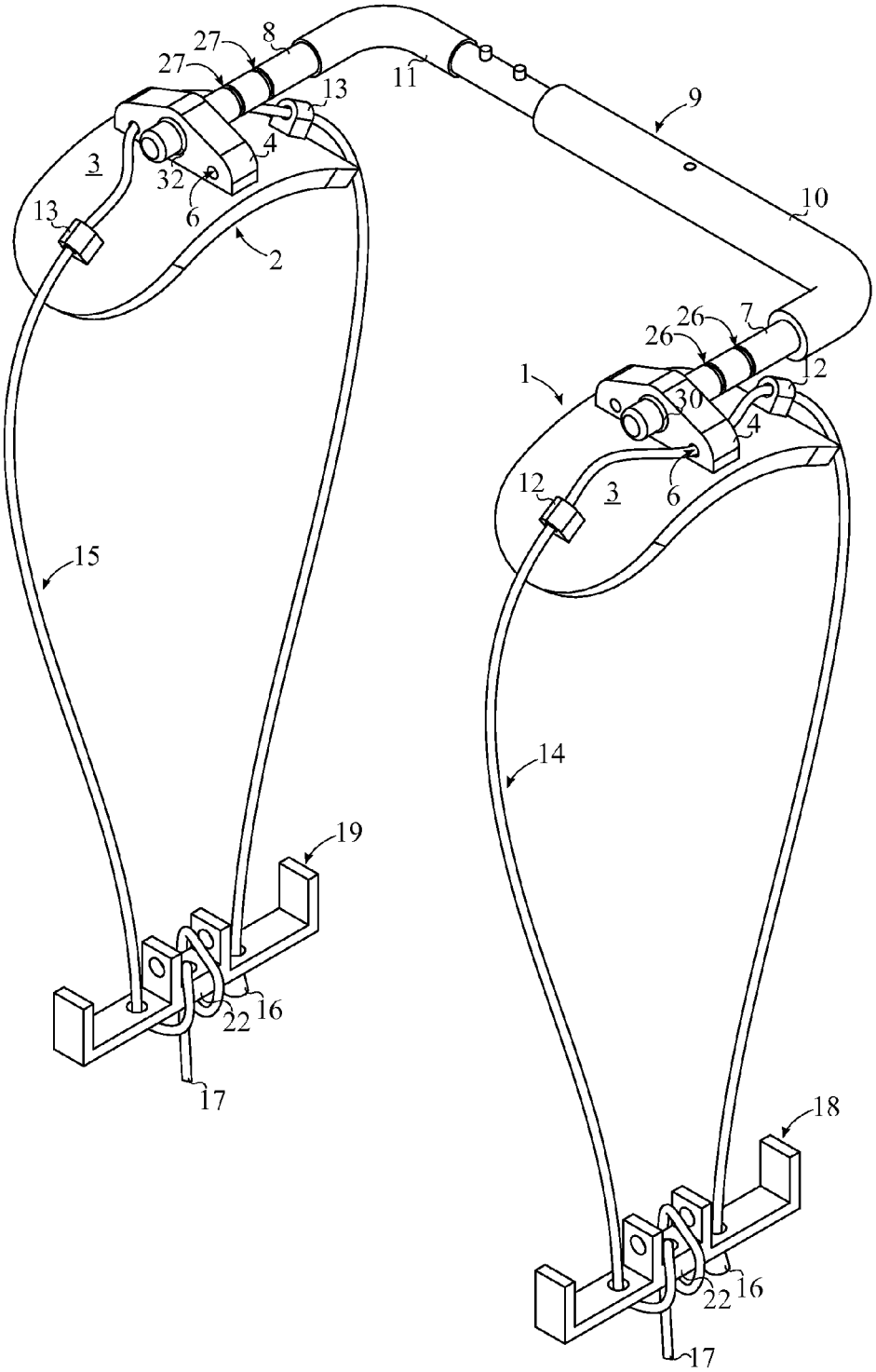
FIG. 6 is a perspective view of the present invention depicting use of the spool portion.

As shown in FIG. 1 and FIG. 2, the left load-bearing hanger 18 and the right load-bearing hanger 19 each comprise a front hook portion 20, a rear hook portion 21, a spool portion 22, a front hanger through hole 23, a rear hanger through hole 24, and an anchoring hole 25. The front hook portion 20 and the rear hook portion 21 are utilized to hold and support a load such as a plastic shopping bag. In this example, the two loops forming the handles of the plastic shopping bag are placed over the front hook portion 20 and the rear hook portion 21. The front hanger through hole 23 and the rear hanger through hole 24 are utilized to secure the left cord 14 and the right cord 15 to the left load-bearing hanger 18 and the right load-bearing hanger 19, respectively. The spool portion 22 allows the length of the left cord 14 and the right cord 15 to be adjusted by wrapping a portion of the left cord 14 and the right cord 15 around the spool portion 22. When the length of the left cord 14 and the length of the right cord 15 have been adjusted, the left cord 14 is positioned around the spool portion 22 of the left load-bearing hanger 18 while the right cord 15 is positioned around the spool portion 22 of the right load-bearing hanger 19 in order to secure the left cord 14 and the right cord 15 around the spool portion 22 as shown in FIG. 6. The anchoring hole 25 is utilized to prevent the left cord 14 and the right cord 15 from unraveling after length adjustment. The front hook portion 20 is connected adjacent to the spool portion 22 while the rear hook portion 21 is also connected adjacent to the spool portion 22, opposite to the front hook portion 20. This allows the weight of a load borne by the left load-bearing hanger 18 or the right load-bearing hanger 19 to be evenly distributed along the length of the left load-bearing hanger 18 or the right load-bearing hanger 19. The front hanger through hole 23 traverses through the front hook portion 20, adjacent to the spool portion 22 while the rear hanger through hole 24 traverses through the rear hook portion 21, also adjacent to the spool portion 22. This allows the left load-bearing hanger 18 and the right load-bearing hanger 19 to be supported evenly when attached to the left cord 14 and the right cord 15, respectively. The anchoring hole 25 traverses through the spool portion 22 allowing the left cord 14 and the right cord 15 to be threaded through the anchoring hole 25 and held in place (for example, by tying a knot) after the lengths of the left cord 14 and the right cord 15 have been adjusted.

The left cord 14 and the right cord 15 each comprise a stopper end 16. The stopper end 16 is utilized to physically prevent the left cord 14 and the right cord 15 from separating from the left load-bearing hanger 18 and the right load-bearing hanger 19. As seen in FIGS. 1-3 and FIG. 6, the left cord 14 traverses through the front hanger through hole 23 and the rear hanger through hole 24 of the left load-bearing hanger 18. Similarly, the right cord 15 traverses through the front hanger through hole 23 and the rear hanger through hole 24 of the right load-bearing hanger 19. This provides two points of connection for the left cord 14 and the right cord 15 to the left load-bearing hanger 18 and the right load-bearing hanger 19, respectively. In addition to preventing the left cord 14 and the right cord 15 from separating from the left load-bearing hanger 18 and the right load-bearing hanger 19, the stopper end 16 allows the user to adjust the length of the left cord 14 and the right cord 15 as needed. The stopper end 16 of the left cord 14 is positioned adjacent to the rear hanger through hole 24 of the left load-bearing hanger 18 while the stopper end 16 of the right cord 15 is positioned adjacent to the rear hanger through hole 24 of the right load-bearing hanger 19. This allows the stopper end 16 to stay in place while the lengths of the left cord 14 and the right cord 15 are adjusted and fixed (for example, by tying a knot).

In addition to the stopper end 16, the left cord 14 and the right cord 15 each comprise a free end 17. The free end 17 is utilized to adjust the length of the left cord 14 and the right cord 15 in order to adjust the positioning of loads borne on the left load-bearing hanger 18 and the right load-bearing hanger 19. The free end 17 of the left cord 14 traverses into the anchoring hole 25 of the left load-bearing hanger 18 while the free end 17 of the right cord 15 traverses into the anchoring hole 25 of the right load-bearing hanger 19. The user may then tie a knot about the free end 17 or similarly secure the free end 17 adjacent to the anchoring hole 25 in order to fix the length of the left cord 14 and the right cord 15.

The present invention further comprises a plurality of left annular notches 26, a left front O-ring 30, and a left rear O-ring 31. The plurality of left annular notches 26 is utilized to secure the left linkage rod 7 to the stabilizing guide 4 connected to the left shoulder pad 1 as well as to hold the left linkage rod 7 in place. The left front O-ring 30 and the left rear O-ring 31 are utilized in conjunction with the plurality of left annular notches 26 to hold the left linkage rod 7 in place. The plurality of left annular notches 26 is positioned along the left linkage rod 7, allowing the user to position the stabilizing guide 4 at various positions along the length of the left linkage rod 7. Each of the plurality of left annular notches 26 is positioned around the left linkage rod 7 as well in order to allow the left front O-ring 30 and the left rear O-ring 31 to be seated within the plurality of left annular notches 26. The stabilizing guide 4 of the left shoulder pad 1 is positioned in between a selected notch 28 and an adjacent notch 29 from the plurality of left annular notches 26 as shown in FIG. 5. This allows the user to fix the stabilizing guide 4 and the left shoulder pad 1 in place in between the selected notch 28 and the adjacent notch 29. The left front O-ring 30 is engaged with the selected notch 28 of the plurality of left annular notches 26 while the left rear O-ring 31 is engaged with the adjacent notch 29 of the plurality of left annular notches 26. As such, the left front O-ring 30 and the left rear O-ring 31 are positioned on opposite sides of the stabilizing guide 4 in order to hold the stabilizing guide 4 in place and prevent shifting. The left front O-ring 30 is adjacently pressed against the stabilizing guide 4 while the left rear O-ring 31 is adjacently pressed against the stabilizing guide 4, opposite to the left front O-ring 30. As such, the left front O-ring 30 and the left rear O-ring 31 are securely seated within the corresponding selected notch 28 and adjacent notch 29.

The present invention further comprises a plurality of right annular notches 27, a right front O-ring 32, and a right rear O-ring 33. The plurality of right annular notches 27 allows the user to secure the right linkage rod 8 to the stabilizing guide 4 connected to the right shoulder pad 2 and hold the right linkage rod 8 in place. Similar to the left front O-ring 30 and the left rear O-ring 31, the right front O-ring 32 and the right rear O-ring 33 are utilized in conjunction with the plurality of right annular notches 27 in order to secure the right linkage rod 8 in place. The plurality of right annular notches 27 is positioned along the right linkage rod 8 allowing the user to secure the stabilizing guide 4 along the length of the right linkage rod 8. Each of the plurality of right annular notches 27 is positioned around the right linkage rod 8, allowing the right front O-ring 32 and the right rear O-ring 33 to be securely seated within the plurality of right annular notches 27. The stabilizing guide 4 of the right shoulder pad 2 is positioned in between a selected notch 28 and an adjacent notch 29 from the plurality of right annular notches 27. This allows the stabilizing guide 4 to be held in place in between the selected notch 28 and the adjacent notch 29 as shown in FIG. 5. The right front O-ring 32 is engaged with the selected notch 28 of the plurality of right annular notches 27 while the right rear O-ring 33 is engaged with the adjacent notch 29 of the plurality of right annular notches 27. As such the right front O-ring 32 and the right rear O-ring 33 are securely seated within the corresponding selected notch 28 and adjacent notch 29. The right front O-ring 32 is adjacently pressed against the stabilizing guide 4 while the right rear O-ring 33 is adjacently pressed against the stabilizing guide 4, opposite to the right front O-ring 32. This allows the right front O-ring 32 and the right rear O-ring 33 to be secured in place within the selected notch 28 and the adjacent notch 29, preventing the right front O-ring 32 and the right rear O-ring 33 from shifting.

The object of the present invention is to facilitate the process of carrying loads such as, but not limited to, plastic shopping bags. The present invention allows the user to carry these loads without losing the use of his or her hands or having his or her movement impeded. Additionally, the present invention greatly mitigates the potential for any sudden jerking forces being imparted on the user's shoulders. When a load is borne by the left load-bearing hanger 18 or the right load-bearing hanger 19, the corresponding left shoulder pad 1 or right shoulder pad 2 is able to compress and grip the user's left shoulder or right shoulder. The present invention is comfortable as the plurality of left offset guides 12 and the plurality of right offset guides 13 are positioned in a manner such that loads borne by the left load-bearing hanger 18 and the right load-bearing hanger 19 are distributed evenly along the lengths of the left shoulder pad 1 and the right shoulder pad 2.

Although the present invention has been explained in relation to its preferred embodiment, it is understood that many other possible modifications and variations can be made without departing from the spirit and scope of the present invention as hereinafter claimed.

What is claimed is:

1. A shoulder carry assist comprises:
- a left shoulder pad;
- a right shoulder pad;
- a left linkage rod;
- a right linkage rod;
- a width-adjustable crossbar;
- a left cord;
- a right cord;
- a left load-bearing hanger;
- a right load-bearing hanger;
- the left shoulder pad being slidably mounted to the left linkage rod;
- the right shoulder pad being slidably mounted to the right linkage rod;
- the left linkage rod being adjacently connected to the width-adjustable crossbar;
- the right linkage rod being adjacently connected to the width-adjustable crossbar, opposite to the left linkage rod;
- the left load-bearing hanger being tethered to the left shoulder pad by the left cord; and
- the right load-bearing hanger being tethered to the right shoulder pad by the right cord.

2. The shoulder carry assist as claimed in claim 1 further comprises:
- the width-adjustable crossbar comprises a sleeve and a lockable rod;
- the left linkage rod being adjacently connected to the sleeve;
- the lockable rod being telescopically engaged into the sleeve, opposite to the left linkage rod; and
- the right linkage rod being adjacently connected to the lockable rod, opposite to the sleeve.

3. The shoulder carry assist as claimed in claim 2 further comprises:
- the left linkage rod being positioned perpendicular to the sleeve; and
- the right linkage rod being positioned perpendicular to the lockable rod.

4. The shoulder carry assist as claimed in claim 1 further comprises:
- the width-adjustable crossbar comprises a sleeve and a lockable rod;
- the right linkage rod being adjacently connected to the lockable rod;
- the lockable rod being telescopically engaged into the sleeve, opposite to the left linkage rod; and
- the left linkage rod being adjacently connected to the sleeve, opposite to the lockable rod.

5. The shoulder carry assist as claimed in claim 4 further comprises:
- the right linkage rod being positioned perpendicular to the sleeve; and
- the left linkage rod being positioned perpendicular to the lockable rod.

6. The shoulder carry assist as claimed in claim 1 further comprises:
- a plurality of left offset guides;
- the left cord traversing through each of the plurality of left offset guides;
- the left load-bearing hanger being slidably connected along the left cord; and
- the plurality of left offset guides being distributed about an upper convex surface of the left shoulder pad.

7. The shoulder carry assist as claimed in claim 1 further comprises:
- a plurality of right offset guides;
- the right cord traversing through each of the plurality of right offset guides;
- the right load-bearing hanger being slidably connected along the right cord; and
- the plurality of right offset guides being distributed about an upper convex surface of the right shoulder pad.

8. The shoulder carry assist as claimed in claim 1 further comprises:
- the left shoulder pad and the right shoulder pad each comprise an upper convex surface, a stabilizing guide, a rod through hole, and at least one cord hole;
- the stabilizing guide being positioned centrally about and connected normal to the upper convex surface;
- the rod through hole traversing through the stabilizing guide tangent to the upper convex surface;
- the rod through hole being positioned centrally on the stabilizing guide;
- the left linkage rod being slidably engaged into the rod through hole of the left shoulder pad;
- the right linkage rod being slidably engaged into the rod through hole of the right shoulder pad;
- the at least one cord hole traversing through the stabilizing guide parallel to the rod through hole;
- the at least one cord hole being positioned adjacent to the rod through hole;
- the left cord traversing through the at least one cord hole of the left shoulder pad; and
- the right cord traversing through the at least one cord hole of the right shoulder pad.

9. The shoulder carry assist as claimed in claim 1 further comprises:
- the left load-bearing hanger and the right load-bearing hanger each comprise a front hook portion, a rear hook portion, a spool portion, a front hanger through hole, a rear hanger through hole, and an anchoring hole;

the front hook portion being connected adjacent to the spool portion;

the rear hook portion being connected adjacent to the spool portion, opposite to the front hook portion;

the front hanger through hole traversing through the front hook portion, adjacent to the spool portion;

the rear hanger through hole traversing through the rear hook portion, adjacent to the spool portion; and the anchoring hole traversing through the spool portion.

10. The shoulder carry assist as claimed in claim 1 further comprises:

the left cord being positioned around the spool portion of the left load-bearing hanger; and the right cord being positioned around the spool portion of the right load-bearing hanger.

11. The shoulder carry assist as claimed in claim 1 further comprises:

the left load-bearing hanger and the right load-bearing hanger each comprise a front hanger through hole and a rear hanger through hole;

the left cord and the right cord each comprise a stopper end;

the left cord traversing through the front hanger through hole and the rear hanger through hole of the left load-bearing hanger;

the stopper end of the left cord being positioned adjacent to the rear hanger through hole of the left load-bearing hanger;

the right cord traversing through the front hanger through hole and the rear hanger through hole of the right load-bearing hanger; and the stopper end of the right cord being positioned adjacent to the rear hanger through hole of the right load-bearing hanger.

12. The shoulder carry assist as claimed in claim 1 further comprises:

the left load-bearing hanger and the right load-bearing hanger each comprise an anchoring hole;

the left cord and the right cord each comprise a free end;

the free end of the left cord traversing into the anchoring hole of the left load-bearing hanger; and the free end of the right cord traversing into the anchoring hole of the right load-bearing hanger.

13. The shoulder carry assist as claimed in claim 1 further comprises:

a plurality of left annular notches;

a left front O-ring;

a left rear O-ring;

the plurality of left annular notches being positioned along the left linkage rod;

each of the plurality of left annular notches being positioned around the left linkage rod;

a stabilizing guide of the left shoulder pad being positioned in between a selected notch and an adjacent notch from the plurality of left annular notches;

the left front O-ring being engaged with the selected notch of the plurality of left annular notches;

the left front O-ring being adjacently pressed against the stabilizing guide;

the left rear O-ring being engaged with the adjacent notch of the plurality of left annular notches; and the left rear O-ring being adjacently pressed against the stabilizing guide, opposite to the left front O-ring.

14. The shoulder carry assist as claimed in claim 1 further comprises:

a plurality of right annular notches;

a right front O-ring;

a right rear O-ring;

the plurality of right annular notches being positioned along the right linkage rod;

each of the plurality of right annular notches being positioned around the right linkage rod;

a stabilizing guide of the right shoulder pad being positioned in between a selected notch and an adjacent notch from the plurality of right annular notches;

the right front O-ring being engaged with the selected notch of the plurality of right annular notches;

the right front O-ring being adjacently pressed against the stabilizing guide;

the right rear O-ring being engaged with the adjacent notch of the plurality of right annular notches; and the right rear O-ring being adjacently pressed against the stabilizing guide, opposite to the right front O-ring.

15. A shoulder carry assist comprises:

a left shoulder pad;

a right shoulder pad;

a left linkage rod;

a right linkage rod;

a width-adjustable crossbar;

a left cord;

a right cord;

a left load-bearing hanger;

a right load-bearing hanger;

a plurality of left offset guides;

a plurality of right offset guides;

the left shoulder pad being slidably mounted to the left linkage rod;

the right shoulder pad being slidably mounted to the right linkage rod;

the left linkage rod being adjacently connected to the width-adjustable crossbar;

the right linkage rod being adjacently connected to the width-adjustable crossbar, opposite to the left linkage rod;

the left load-bearing hanger being tethered to the left shoulder pad by the left cord;

the right load-bearing hanger being tethered to the right shoulder pad by the right cord;

the left cord traversing through each of the plurality of left offset guides;

the left load-bearing hanger being slidably connected along the left cord;

the plurality of left offset guides being distributed about an upper convex surface of the left shoulder pad;

the right cord traversing through each of the plurality of right offset guides;

the right load-bearing hanger being slidably connected along the right cord; and the plurality of right offset guides being distributed about an upper convex surface of the right shoulder pad.

16. The shoulder carry assist as claimed in claim 15 further comprises:

the width-adjustable crossbar comprises a sleeve and a lockable rod;

the left linkage rod being adjacently connected to the sleeve;

the lockable rod being telescopically engaged into the sleeve, opposite to the left linkage rod;

the right linkage rod being adjacently connected to the lockable rod, opposite to the sleeve;

the left linkage rod being positioned perpendicular to the sleeve;

the right linkage rod being positioned perpendicular to the lockable rod;

the right linkage rod being adjacently connected to the lockable rod;

the left linkage rod being adjacently connected to the sleeve, opposite to the lockable rod;

the right linkage rod being positioned perpendicular to the sleeve; and the left linkage rod being positioned perpendicular to the lockable rod.

17. The shoulder carry assist as claimed in claim 15 further comprises:

the left shoulder pad and the right shoulder pad each comprise an upper convex surface, a stabilizing guide, a rod through hole, and at least one cord hole;

the stabilizing guide being positioned centrally about and connected normal to the upper convex surface;

the rod through hole traversing through the stabilizing guide tangent to the upper convex surface;

the rod through hole being positioned centrally on the stabilizing guide;

the left linkage rod being slidably engaged into the rod through hole of the left shoulder pad;

the right linkage rod being slidably engaged into the rod through hole of the right shoulder pad;

the at least one cord hole traversing through the stabilizing guide parallel to the rod through hole;

the at least one cord hole being positioned adjacent to the rod through hole;

the left cord traversing through the at least one cord hole of the left shoulder pad; and the right cord traversing through the at least one cord hole of the right shoulder pad.

18. The shoulder carry assist as claimed in claim 15 further comprises:

the left load-bearing hanger and the right load-bearing hanger each comprise a front hook portion, a rear hook portion, a spool portion, a front hanger through hole, a rear hanger through hole, and an anchoring hole;

the left cord and the right cord each comprise a stopper end and a free end;

the front hook portion being connected adjacent to the spool portion;

the rear hook portion being connected adjacent to the spool portion, opposite to the front hook portion;

the front hanger through hole traversing through the front hook portion, adjacent to the spool portion;

the rear hanger through hole traversing through the rear hook portion, adjacent to the spool portion;

the anchoring hole traversing through the spool portion;

the left cord being positioned around the spool portion of the left load-bearing hanger;

the right cord being positioned around the spool portion of the right load-bearing hanger;

the left cord traversing through the front hanger through hole and the rear hanger through hole of the left load-bearing hanger;

the stopper end of the left cord being positioned adjacent to the rear hanger through hole of the left load-bearing hanger;

the right cord traversing through the front hanger through hole and the rear hanger through hole of the right load-bearing hanger;

the stopper end of the right cord being positioned adjacent to the rear hanger through hole of the right load-bearing hanger;

the free end of the left cord traversing into the anchoring hole of the left load-bearing hanger; and the free end of the right cord traversing into the anchoring hole of the right load-bearing hanger.

19. The shoulder carry assist as claimed in claim 15 further comprises:

a plurality of left annular notches;

a left front O-ring;

a left rear O-ring;

the plurality of left annular notches being positioned along the left linkage rod;

each of the plurality of left annular notches being positioned around the left linkage rod;

a stabilizing guide of the left shoulder pad being positioned in between a selected notch and an adjacent notch from the plurality of left annular notches;

the left front O-ring being engaged with the selected notch of the plurality of left annular notches;

the left front O-ring being adjacently pressed against the stabilizing guide;

the left rear O-ring being engaged with the adjacent notch of the plurality of left annular notches; and the left rear O-ring being adjacently pressed against the stabilizing guide, opposite to the left front O-ring.

20. The shoulder carry assist as claimed in claim 15 further comprises:

a plurality of right annular notches;

a right front O-ring;

a right rear O-ring;

the plurality of right annular notches being positioned along the right linkage rod;

each of the plurality of right annular notches being positioned around the right linkage rod;

a stabilizing guide of the right shoulder pad being positioned in between a selected notch and an adjacent notch from the plurality of right annular notches;

the right front O-ring being engaged with the selected notch of the plurality of right annular notches;

the right front O-ring being adjacently pressed against the stabilizing guide;

the right rear O-ring being engaged with the adjacent notch of the plurality of right annular notches; and the right rear O-ring being adjacently pressed against the stabilizing guide, opposite to the right front O-ring.

* * * * *